US005737853A

United States Patent [19]

Smejkal

[11] Patent Number: 5,737,853

[45] Date of Patent: Apr. 14, 1998

[54] CONVERTIBLE THONG BEACH SHOE

[76] Inventor: Miroslav Smejkal, 32-14 45th St., Long Island City, N.Y. 11103

[21] Appl. No.: 788,655

[22] Filed: Jan. 24, 1997

Related U.S. Application Data

[60] Provisional application No. 60/010,659, Jan. 26, 1996.

[51] Int. Cl. [6] ..... A43B 3/12

[52] U.S. Cl. ..... 36/11.5

[58] Field of Search ..... 36/11.5

[56] References Cited

U.S. PATENT DOCUMENTS

| | | | |
|---|---|---|---|
| 4,030,212 | 6/1977 | Ito | 36/11.5 |
| 4,864,736 | 9/1989 | Bierk | 36/11.5 |
| 5,615,496 | 4/1997 | Sharpstein | 36/11.5 |

FOREIGN PATENT DOCUMENTS

| | | | |
|---|---|---|---|
| 2624355 | 6/1989 | France | 36/11.5 |

*Primary Examiner*—Paul T. Sewell
*Assistant Examiner*—Anthony Stashick
*Attorney, Agent, or Firm*—Scully, Scott, Murphy & Presser

[57] ABSTRACT

A shoe sole which is convertible into a shoe. More particularly, a shoe sole is constituted of a flexible material wherein predetermined notch-like cut-outs and incisions may be provided in the shoe sole, with the latter being in a generally planar condition while not in use or when adapted to be stored and/or carried, and whereby the shoe sole may then be bent along the predetermined incision lines so as to cause deformed or bent portions thereof to engage into respective of the cut-outs or notches so as to form a foot-receiving shoe structure; for example, in the nature of a beach shoe, thong, sandal or the like.

7 Claims, 1 Drawing Sheet

CONVERTIBLE THONG BEACH SHOE

BACKGROUND OF THE INVENTION

1. Field of the Invention

This Application claims the benefit of U.S. Provisional application Ser. No. 60/010,659 filed Jan. 26, 1996. The present invention relates to a shoe sole which is convertible into a shoe. More particularly, the invention is directed to a shoe sole which is constituted of a flexible material wherein predetermined notch-like cut-outs and incisions may be provided in the shoe sole, with the latter being in a generally planar condition while not in use or when adapted to be stored and/or carried, and whereby the shoe sole may then be bent along the predetermined incision lines so as to cause deformed or bent portions thereof to engage into respective of the cut-outs or notches so as to form a foot-receiving shoe structure; for example, in the nature of a beach shoe, thong, sandal or the like.

In general, the utilization and wearing of so-called beach shoes, thongs, and sandals has found widespread application and public approval inasmuch as such wear is generally comfortable when worn on a beach or similar casual setting, while being inexpensive to manufacture and readily made from colorful and decorative materials.

2. Discussion of the Prior Art

Although numerous types and kinds of such beach shoes, sandals or shoe thongs are currently known and widely worn, most of these are constituted of a plurality of assembled constituents, such as the shoe sole and an upper shoe structure which is attached thereto in order to form the entire shoe, thong or sandal construction. This renders the manufacture of such shoe wear complicated in nature and, resultingly, relatively expensive.

Reverting to the prior art in greater particularity, Stein U.S. Pat. No. 5,438,767 discloses a sandal which includes adjustable straps which are fastened to a flexible sole construction. In this particular instance, the sandal is constructed of a multiplicity of components which renders the sandal expensive to construct and unable to be compactly stored and packaged.

Smith U.S. Pat. No. 4,267,649 discloses a shoe having a plurality of strap members patchable to a sole structure. This also is of a complex multicomponent construction and fails to provide the versatility and flexibility of the present unitarily constructed thong beach shoe.

Smith U.S. Pat. No. 4,114,296 also includes a shoe which has detachable upper portions which are constituted of separate components from a sole. This is also a relatively complex arrangement.

Kennedy U.S. Pat. No. 3,798,803 discloses a beach sandal which includes a plurality of strap mountable on a sole, and requires various components including closures and straps, rendering the construction complex and expensive.

SUMMARY OF THE INVENTION

According to the present invention, the shoe construction which is disclosed herein is produced from a single piece or unitary shoe sole which is constituted of a generally flexible material, preferably such as a natural or synthetic rubber or similar resiliently flexible synthetic material, which may be suitably imparted with various decorative colorings and/or designs so as to render the entire appearance thereof aesthetically pleasing to a potential customer, and whereby the shoe sole, which is initially of a planar or flat construction, includes a plurality of through-extending incisions and notches enabling it to be easily deformed into a shoe configuration ready to be worn on the foot of a wearer, while eliminating the need for the provision of additional shoe components in the formation of the shoe.

In view of the foregoing it is an object of the present invention to provide a convertible thong beach shoe which is constituted from a single piece construction.

A more specific object of the invention resides in the provision of a flexible shoe sole which incorporates incisions and cut-outs enabling the sole to be bent into a configuration consistent with a thong beach shoe, thereby rendering the structure simple and inexpensive.

BRIEF DESCRIPTION OF THE DRAWINGS

Referring to a preferred embodiment of the invention, particular reference may now be had to the accompanying drawings; in which.

DETAILED DESCRIPTION OF A PREFERRED EMBODIMENT

Figure 2:
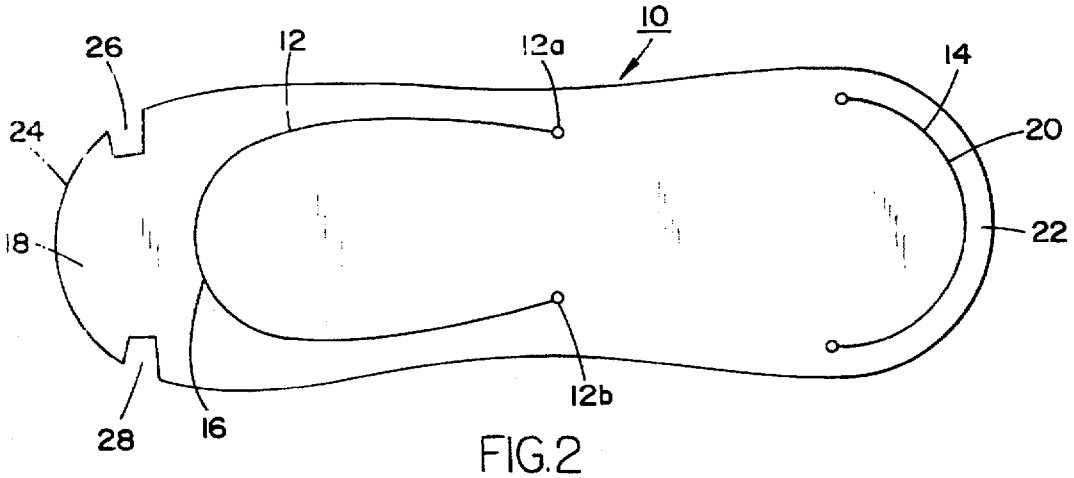
FIG. 2 illustrates a plan view of the generally planar shoe sole prior to being formed into the shoe of FIG. 1.
Figure 3:
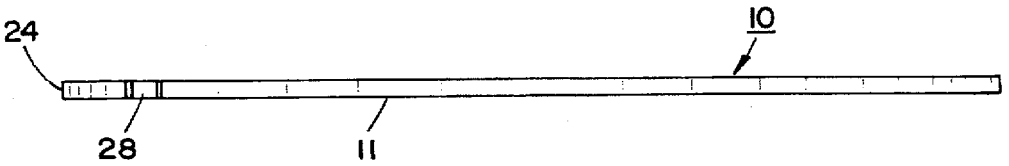
FIG. 3 illustrates a side view of the shoe sole of FIG. 2.

Having specific reference to FIGS. 2 and 3 of the drawings, there is illustrated a generally flat shoe sole construction 10, which may be made in various sizes so as to be selectively fittable to the foot sizes of a wide range of adult male or female, or children's feet, as desired. In this case, in plan view the shoe sole 10 is of a generally standard foot configuration and may be adapted to either the left or right foot of a prospective wearer by simply being molded or cut to the appropriate configuration, in this instance, only a single shoe sole being illustrated in the drawing with the sole for the other foot being essentially a mirror-image thereof. The material for the shoe sole 10, as indicated hereinabove, may be of any expediently flexible or elastomeric material, such as natural or synthetic rubber, neoprene, or suitable flexible natural, synthetic or plastic material. The shoe sole 10 may be of a nature so as to have a bottom surface 11 of a texture providing non-skid gripping engagement or contact with a potentially slippery floor or ground in order to inhibit any slipping of the wearer of the shoe, for example, when walking on a wet surface. The shoe sole 10 may be imparted suitable coloring agents and/or decorative patterns, indicia, designs, logos and decals, during manufacture so as to render the shoe structure aesthetically attractive to a potential customer.

As shown in the plan view of FIG. 2, a pair of curvilinear slits 12, 14 are cut into the sole 10 so as to extend through the full thickness thereof, with the slit 12 extending curvilinearly proximate the heel portion 16 of the sole, so as to leave a relatively wide strip 18 extending inwardly therealong; and with the slit 14 which is also of a generally curvilinear configuration extending through the thickness of the sole and being proximate the toe portion 20 of the shoe sole 10 so as to leave a somewhat narrower strip 22 extending along the toe edge portion thereof.

Formed proximate the heel end 24 of the planar shoe sole 10, and at opposite sides thereof in the heel strip 18 are a pair of generally rectangular cut-outs or notches 26, 28, the cross-section of each being generally in conformance with the cross-section dimensions of strip 22.

Figure 1:
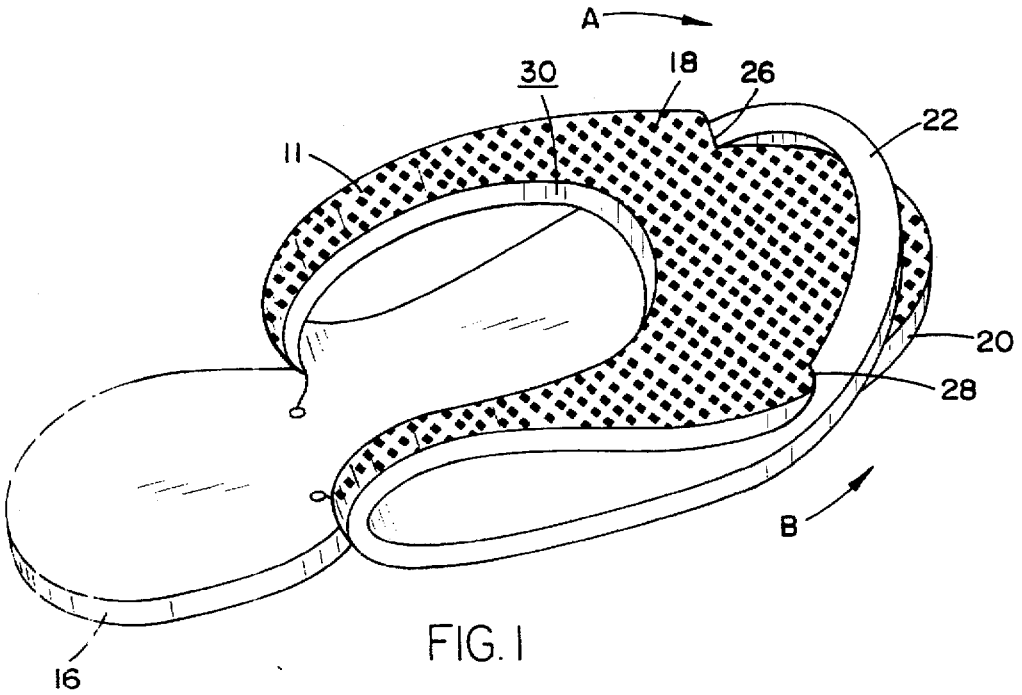
FIG. 1 illustrates a perspective view of a thong-like shoe formed by the unitarily-constructed shoe sole.

In order to form a complete shoe of thong configuration from the initially flat or planar shoe sole 10, as illustrated in FIG. 1 of the drawings, it is merely necessary to pull up the heel strip 18 of the heel portion 16 defined by the ends 12*a*, 12*b* of slit 12 and to bend that heel portion upwardly and forwardly over the sole, in the direction of arrow A. Thereupon, the toe strip 22 at the toe portion 20 is bent upwardly over the forwardly bent heel strip 18 in the direction of arrow B so as to engage into the notches 26, 28 initially formed in the strip 18 of heel portion 16, and which are now superimposed above the toe portion 20 of the sole 10 so as to form in conjunction therewith and engagement with the portion of the sole 10 extending therebeneath the upper 30 of a flexible shoe or thong, into which resulting space therebetween the toes and front part of a wearer's foot may be readily inserted.

The foregoing, in a simple formative manner, by merely bending the sole strip portion 18 containing the notches 26, 28 upwardly and forwardly and engaging in the latter the other or toe strip portion 22 of the sole, enables the unitary shoe sole 10 to be deformed into a wearable shoe configuration.

The inventive structure completely eliminates the need for additional shoe components and enables the entire construction to be inexpensively formed from a unitary or single-piece initially flat shoe sole. In the disengaged nature of the components, the entire shoe sole is essentially a simple flat element which, in conjunction with a mating similarly formed shoe sole for the other foot of a wearer, may be compactly arranged in a suitable travel case or other storage area, while taking up a minimum amount of space.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A convertible shoe construction constituted of a unitary component, said component comprising an initially flexible planar member having the configuration of a shoe sole; including elongate slits in respectively the heel portion and toe portions of said shoe sole forming a strip element at said heel portion and a strip element at said toe portion each having the ends thereof connected to said shoe sole, said strip element at the heel portion having cutouts formed at opposite edges, whereby upon said heel strip element being bent upwardly and forwardly above said shoe sole, said toe strip element is bent upwardly and engages into said cutouts to form a thong-like shoe.

2. A convertible shoe construction as claimed in claim 1, wherein said heel strip element is wider than said toe strip element so as to form a shoe upper when engaged therewith.

3. A convertible shoe construction as claimed in claim 1, wherein said elongate slits are curvilinear in correlation with the curvatures of the shoe sole heel and tow and extend through the thickness of said shoe sole.

4. A convertible show construction as claimed in claim 1, wherein said shoe sole has a bottom surface having a texture inhibiting slipping of a wearer of said shoe construction.

5. A convertible shoe construction as claimed in claim 1, wherein said shoe sole is selected from the group of materials consisting of natural rubber, synthetic rubber, neoprene, and elastomeric natural materials and plastics.

6. A convertible shoe construction as claimed in claim 1, wherein said sole material includes at least one coloring agent.

7. A convertible shoe construction as claimed in claim 1, wherein said sole includes surface portions selectively imparted with decorative patterns, indicia, designs, logos and decals.

* * * * *